United States Patent [19]

Kurata et al.

[11] Patent Number: 4,462,704

[45] Date of Patent: Jul. 31, 1984

[54] THERMAL HEAT DRIVING SYSTEM

[75] Inventors: Masami Kurata; Toshiharu Inui, both of Kanagawa, Japan

[73] Assignee: Fuji Xerox Co., Ltd., Tokyo, Japan

[21] Appl. No.: 446,308

[22] Filed: Dec. 3, 1982

[30] Foreign Application Priority Data

Dec. 4, 1981 [JP] Japan ..... 56-194439

[51] Int. Cl.[3] ..... B41J 3/02

[52] U.S. Cl. ..... 400/120; 346/76 PH; 219/216

[58] Field of Search ..... 400/120; 219/216, 216 PH; 346/76 PH

[56] References Cited

U.S. PATENT DOCUMENTS 3,984,809 10/1976 Dertouzos et al. ..... 346/76 PH 4,038,516 7/1977 Bergvall ..... 219/216 PH 4,113,391 9/1978 Minowa ..... 219/216 PH X

*Primary Examiner*—E. H. Eickholt

*Attorney, Agent, or Firm*—Sughrue, Mion, Zinn, Macpeak, and Seas

[57] ABSTRACT

A thermal head driving system having a plurality of thermal heads, an electric power source commonly used to drive the heads at the same voltage. A pulse generator provided between the power source and each of the heads for producing a driving pulse having a width determined in accordance with a ratio of a resistance value of each thermal head. The plurality of thermal heads are accordingly driven by the respective driving pulses corresponding thereto to effectuate thermal recording.

4 Claims, 5 Drawing Figures

THERMAL HEAT DRIVING SYSTEM

BACKGROUND OF THE INVENTION

The present invention relates to a thermal head driving system for use in multicolor or polychromatic printers or duplex or perfecting printers.

In a thermal transferring recording system, for example, a thermal pulse is applied onto a recording medium on which thermally transferable ink (ink having thermal fluidity or sublimatable ink) has been applied (hereinafter referred to as an "ink donor sheet"), so that fluid or sublimated ink is transferred to a sheet of recording paper thereby recording picture information thereon.

FIG. 1 illustrates the principle of recording by a multicolor or polychromatic printer which employs the recording system as mentioned above. A first ink donor sheet on which, for example, black ink has been applied is fed out of a first supply roll 2P, passes between a first backing-up roller 3P and a first thermal head 4P, and is then reeled up on a first winding-up roll 5P. A second ink donor sheet 1Q on which, for example, red ink has been applied is fed out of a second supply roll 2Q, passed between a second backing-up roller 3Q and a second thermal head 4Q, and is then reeled up on a second winding-up roll 5Q. A sheet of recording paper 6 travels in the direction indicated by an arrow to pass first between the first ink donor sheet 1P and the first backing-up roller 3P and then between the second ink donor sheet 1Q and the second backing-up roller 3Q. Thus, two-color recording, in red and black, is accomplished. Similarly, multicolor recording in three colors or more can be made if further recording sections are additionally provided.

FIG. 2 illustrates the principle of recording by a duplex recording printer. At one side (upper side in FIG. 2) with respect to a traveling path 7 of a sheet of recording paper 6, a first supply roll 8A is provided for recording on a first surface of the recording paper 6. An ink donor sheet 8A fed out of the first supply roll 9A passes by the respective under surfaces of a first backing-up roller 3P and a second thermal head 4Q and is then reeled up on a winding-up roll 13A. At the other side (lower side in the drawing) with respect to the traveling path 7, a second supply roll 8B is provided for recording on a second surface of the recording paper 6. A second ink donor sheet 9B fed out of the second supply roll 8B passes by the respective upper surfaces of a first thermal head 4P and a second backing-up roller 3Q which are provided respectively oppositely to the first backing-up roller 3P and the second thermal head 4Q, and is then reeled up on a second winding-up roll 13B.

In this printer, if the recording paper 6 is moved in the direction indicated by an arrow, picture information is first recorded onto the lower surface of the recording paper by the first thermal head 4P and then recorded onto the upper surface of the same by the second thermal head 4Q.

Thus, a plurality of thermal heads are simultaneously driven to record picture information in a multicolor or polychromatic printer or in a duplex or perfecting printer. FIG. 3 shows a conventional thermal head driving system for use in such printers. The respective resistors of thermal heads may result in a variance of their respective resistance values. If thermal heads have different resistance values, the respective amount of heat generated in the thermal heads differ one from another. This results in a poor recorded picture having portions which differ in density one from another depending on the resistance values of the thermal heads. Conventionally, therefore, a number of power sources equal to the number of thermal heads have been provided to separately adjust the amount of heat generated in the individual thermal heads.

Thus, in the two examples as mentioned above, two power sources 15 and 16 have been provided corresponding to the thermal heads 4P and 4Q, as shown in FIG. 3. The respective output voltages of these power sources 15 and 16 are adjusted to be $V_P$ and $V_Q$ in accordance with the resistance values of the thermal heads 4P and 4Q. Assuming that, for example, the respective resistance values of the first and second thermal heads 4P and 4Q are 320Ω and 360Ω, the output voltages $V_P$ and $V_Q$ are adjusted, for example, to be 21 volts and 22 volts, respectively. Thus, the first power source supplies its adjusted output voltage $V_P$ to a first driver 17 to drive the first thermal head 4P in accordance with a first picture signal 18. Similarly thereto, the second power source 18 supplies its adjusted output voltage $V_Q$ to a second driver 19 to drive the second thermal head 4Q in accordance with a second picture signal 21.

Thus, in a thermal head driving system as mentioned above, it has been necessary to provide a number of power sources of the same performance equal to the number of thermal heads, resulting in poor economy and duplication of equipment.

SUMMARY OF INVENTION

The present invention is intended to eliminate such a defect as mentioned above in the conventional thermal head driving system.

An object of the present invention is to provide a thermal head driving system in which a plurality of thermal heads can be driven by the same power source.

According to the present invention, the above-mentioned and other objects of this invention are attained by adjusting the width of a pulse signal produced by the power source and applied to each head, in accordance with the particular resistance value of the head.

Preferred embodiments of the present invention will now be described by referring to the drawing and the description of the preferred embodiment that follow.

DESCRIPTION OF THE PREFERRED EMBODIMENT

Figure 4:
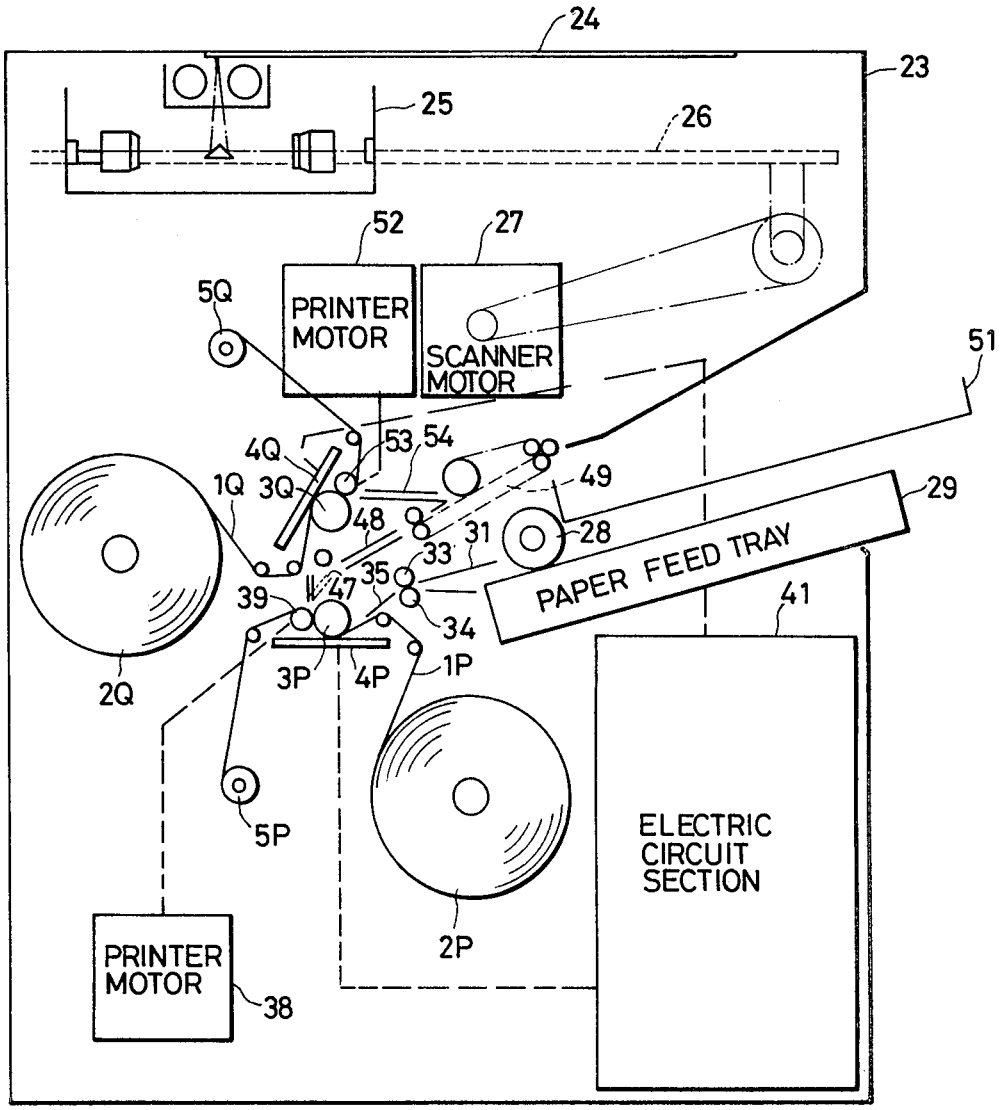
FIG. 4 is a block diagram illustrating the configuration of an embodiment of the two-color recording apparatus according to the present invention.

FIG. 4 illustrates a two-color recording apparatus of the type for thermal transferring recording. In this recording apparatus, a portion of an original document described in red is recorded or copied in red color and another portion described in colors other than red and white is recorded or copied in black. Alternatively, the original document can be recorded or copied only in black in accordance with the density of portions of the document. To this end, a reading device 25 for two colors, red and black, is provided directly under a glass platen 24 mounted on the upper surface of the body 23 of the recording apparatus. The reading device 25 is arranged such that it may reciprocate along a rail 26 provided in parallel with the glass platen 24 to scan (or subscan) the picture image on the original document. The reading device 25 is driven by a scanner motor 27.

Below the reading device 25, a printer selection is provided for effecting two-color recording in black and in red. A description will be made first with respect to the case where recording is made only in black in the printer section.

In response to the instructions from a control board (not shown) to record or copy only in black and to start the recording operation, a supply roller 28 is driven so that a sheet of recording paper is fed out of a paper supply tray 29. The recording paper is guided by a guide 31 until it reaches a pair of feed rollers 33 and 34. From the feed rollers 33 and 34, the recording paper is guided by another guide 35 to enter between a first back-up roller 3P and a first thermal head 4P. At this time, a first printer motor 38 is energized at a predetermined time to cause a first drive roller 39 to begin rotation.

Upon commencement of rotation of the first drive roller 39, a first ink donor sheet 1P which is sandwiched and pressed between the first drive roller 39 and the first backing-up roller 3P is caused to begin movement. Following the movement of the first ink donor sheet 1P, the back-up roller 3P rotates and causes the recording paper to pass directly above the first thermal head 4P, with the recording paper being sandwiched between the first back-up roller 3P and the first ink donor sheet 1P so that thermal transferring recording is made in black. An electrical circuit section 41 disposed below the supply tray 29 processes picture signals produced by the reading device 25 and produces signals for driving the first and second thermal heads 4P and 4Q.

Figure 1:
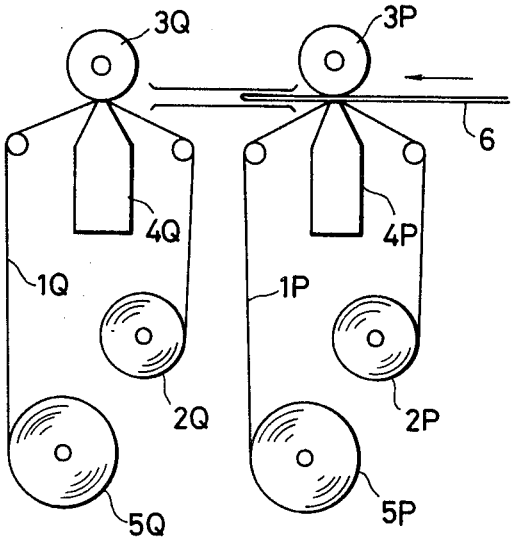
FIG. 1 is a diagram illustrating the principle of a multicolor or polychromatic printer utilizing the thermal transferring recording system.
Figure 2:
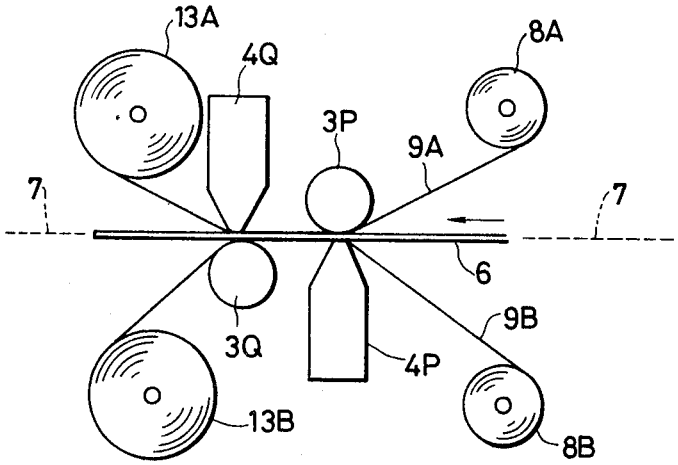
FIG. 2 is a diagram illustrating the principle of a duplex or perfecting printer utilizing the thermal transferring recording system.
Figure 3:
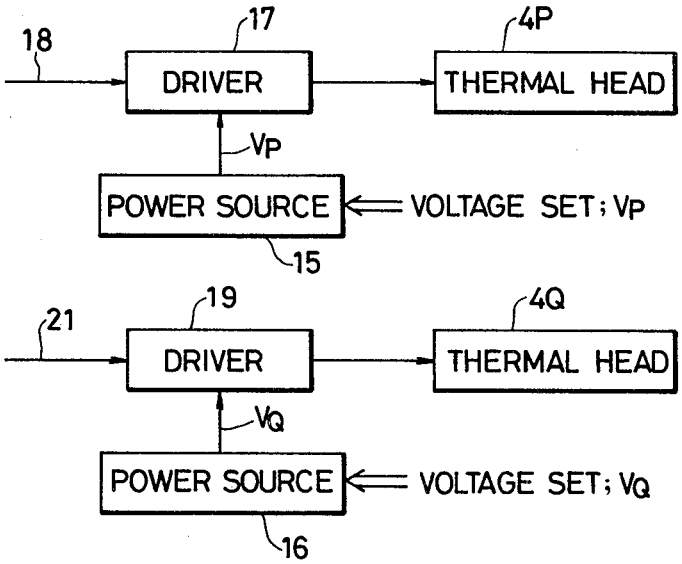
FIG. 3 PRIOR ART
FIG. 3 is a block diagram explaining the conventional thermal head driving system utilizing a plurality of thermal heads.
Figure 5:
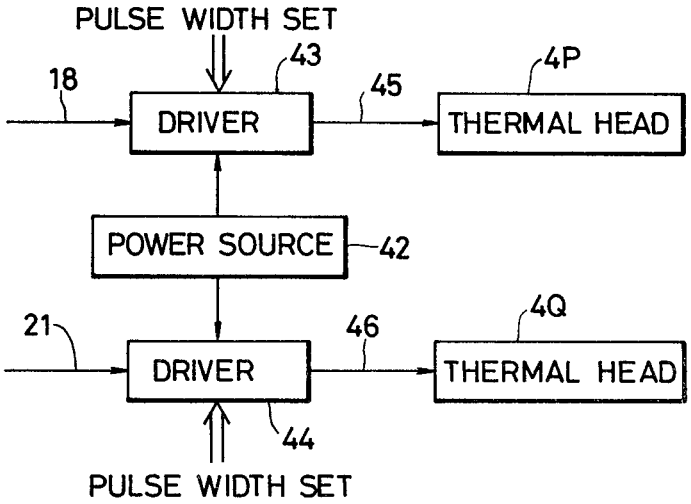
FIG. 5 is a block diagram illustrating the configuration of the thermal head driving system in the embodiment of FIG. 4.

FIG. 5 illustrates a thermal head driving system by means of the electrical circuit section 41. The recording apparatus is provided with a thermal head driving power source 42 and drivers 43 and 44 for driving the thermal heads 4P and 4Q, respectively. The power source 42 is a constant voltage power source producing a d.c. voltage of, for example, 22 volts. The drivers 43 and 44 perform on-off control of the d.c. voltage of the power source 42 in accordance with the first and second picture signals 18 and 21 to produce driving pulses 45 and 46 having pulse widths substantially proportional to the resistance values of the thermal heads 4P and 4Q, respectively. For example, in the case where the resistance values of the first and second thermal heads 4P and 4Q are 320Ω and 360Ω, respectively, the pulse widths of the first and second driving pulses 45 and 46 are set to be 0.9 msec and 1.0 msec, respectively.

Since recording is made in only one color, black, the second driver 43 is at its inoperative state. Accordingly, only the first driver 43 operates so that the heating elements of the first thermal head 4P are selectively actuated to allow a current to pass therethrough for a period of 0.9 msec. The recording paper on which recording has been made in this manner is guided by a guide 47 pushed down to the position indicated by a dotted line and another guide 48 disposed at the exit of the guide 47 to enter a conveyor mechanism 49 and is then released therefrom into a catch tray 51.

The situation where recording is made in two colors of black and red will next be discussed. After passing through between the first back-up roller 3P and the first driver roller, the recording paper on which recording has been made in black by the first thermal head 4P in the manner as mentioned above, is guided by the guide 47 which has been moved to the position indicated by a solid line so as to enter between the second backing roller 3Q and the second thermal head 4Q. At this time, a second printer motor 52 is energized to actuate a second drive roller 53 to begin rotation.

When the second drive roller 53 begins to rotate, the second ink donor sheet 1Q starts movement so that a recording is made in red onto the recording paper which travels together with the second ink donor sheet 1Q. In this case, the second driver 44 is at its operative state to selectively control the heating elements of the second thermal head 4Q to allow a current to pass therethrough. After passing between the second backing-up roller 3Q and the second drive roller 53, the recording paper on which recording has been made in two colors in the manner as mentioned above, is guided by a guide plate 54 to the conveyor mechanism 49 and then released therefrom into the catch tray 51.

As explained herein, according to the present invention, the respective amount of heat generated by individual thermal heads is adjusted by varying the pulse widths of driving pulses for the thermal heads to reduce the number of the power sources required, thereby making the apparatus smaller in size and more efficient.

Although a recording apparatus of the type of thermal transferring recording has been described above as a preferred embodiment of the present invention, the present invention is not to be limited to this type of printing system.

What is claimed is:

1. A thermal head driving system comprising: at least first and second thermal heads, an electric power source used to drive said heads at the same voltage, means disposed between said power source and each of said heads for producing first and second driving pulses for said first and second heads respectively each of said pulses having widths determined such that the ratio of pulse widths is directly proportional to the ratio of resistance values of each of said thermal heads, wherein said first and second thermal heads are driven by said respective first and second driving pulses to effect thermal recording.

2. The thermal head driving system of claim 1, wherein said power source is a constant voltage d.c. source.

3. The thermal head driving system of claim 2, wherein said means disposed between said power source and said heads comprises a driver associated with each thermal head receiving the constant voltage output from said source, and pulse width setting means for each driver to adjust the width of a driving pulse to a respective thermal head.

4. The thermal head driving system of claim 1, wherein said means disposed between said power source and said head comprises a driver associated with each thermal head receiving the constant voltage output from said source, and pulse width setting means for each driver to adjust the width of a driving pulse to a respective thermal head.

* * * * *